United States Patent [19]

Viles

[11] Patent Number: 4,802,890

[45] Date of Patent: Feb. 7, 1989

[54] AGGLOMERATION OF COAL FINES

[75] Inventor: Robert F. Viles, Tamworth, England

[73] Assignee: Fosroc International Limited, Birmingham, England

[21] Appl. No.: 23,389

[22] Filed: Mar. 9, 1987

[30] Foreign Application Priority Data

Apr. 8, 1986 [GB] United Kingdom ..... 8608488

[51] Int. Cl.[4] ..... C10L 5/14; C10L 5/06

[52] U.S. Cl. ..... 44/21; 44/25; 44/596

[58] Field of Search ..... 44/21, 25, 596

[56] References Cited

U.S. PATENT DOCUMENTS

| | | | |
|---|---|---|---|
| 2,567,136 | 9/1951 | Vlowberghs | 44/25 |
| 3,402,031 | 9/1968 | Schick et al. | 44/21 |
| 3,599,433 | 8/1971 | Yaizu et al. . | |
| 3,615,286 | 10/1971 | Vander Linden | 44/21 |
| 3,696,622 | 10/1972 | Tohma et al. . | |
| 4,001,152 | 1/1977 | Lednhardt | 44/6 |
| 4,286,968 | 9/1981 | Casinelli et al. | 44/21 |
| 4,293,312 | 10/1981 | Fox | 44/21 |
| 4,315,961 | 2/1982 | Adam et al. | 44/25 |
| 4,426,467 | 1/1984 | Quist et al. . | |
| 4,468,359 | 8/1984 | Lemon et al. . | |
| 4,474,904 | 10/1984 | Lemon et al. . | |

FOREIGN PATENT DOCUMENTS

| | | |
|---|---|---|
| 1065605 | 3/1960 | Fed. Rep. of Germany . |
| 50-130627 | 10/1975 | Japan . |
| 1438944 | 6/1976 | United Kingdom . |
| 2045800 | 11/1980 | United Kingdom . |
| 2079780 | 1/1982 | United Kingdom . |
| 2082630 | 3/1982 | United Kingdom . |
| 2154593 | 9/1985 | United Kingdom . |

*Primary Examiner*—Carl F. Dees

*Attorney, Agent, or Firm*—Nixon & Vanderhye

[57] ABSTRACT

Coal fines are agglomerated by mixing together the coal fines, a phenol-formaldehyde resole resin in alkaline aqueous solution and a curing agent for the resin comprising one or more esters selected from esters of polyhydric alcohols, carbonate esters and lactones, forming the resulting mixture into agglomerates and drying and curing the agglomerates. A small proportion of a thermoplastics material such as polyvinyl alcohol or an acrylic polymer may be included to improve the surface hardness of the agglomerates, and a small proportion of a material which will improve the coking property and hot strength of the agglomerates, for example finely ground coking coal or bitumen when the coal fines are anthracite fines, may also be included.

14 Claims, No Drawings

AGGLOMERATION OF COAL FINES

This invention relates to a process for the agglomeration of coal fines and in particular to a process for producing agglomerates such as briquettes from wet coal fines, such as anthracite fines, without the need to dry the coal fines before carrying out the process.

A variety of methods are known for producing compacts such as pellets or briquettes from coal fines and these involve the use of binders such as sulphite lye, urea-formaldehyde resin, polyvinyl alcohol or bitumen. In one process when the coal fines contain a high proportion of moisture an inorganic drying additive such as quicklime is also used.

However the known processes have disadvantages. The addition of inorganic materials tends to increase the ash content of the coal fines compact thus reducing the fuel value of the coal while many organic binders make the coal fines/binder mixture sticky and difficult to handle. Furthermore binders such as bitumen produce briquettes which, on combustion, give off large amounts of smoke and which tend to disintegrate too rapidly.

According to the invention there is provided a process for the agglomeration of coal fines comprising producing a mixture of coal fines, a phenol-formaldehyde resole resin in alkaline aqueous solution and a curing agent for the resin comprising one or more esters selected from esters of polyhydric alcohols, carbonate esters and lactones, forming the mixture into agglomerates and drying and curing the agglomerates.

According to a further feature of the invention there is provided an agglomerate comprising coal fines bonded together by a cured phenol-formaldehyde resin bond formed by curing a phenol-formaldehyde resole resin in alkaline aqueous solution with one or more esters selected from esters of polyhydric alcohols, carbonate esters and lactones.

Any type of coal fines may be agglomerated by the process of the invention. For example the coal fines may be anthracite fines or bituminous coal fines. The process is of particular value for agglomerating wet anthracite fines which contain of the order of 5–10% by weight moisture as produced in the processing of coal.

The phenol-formaldehyde resole resin may be prepared for example by reacting together a monohydric phenol such as phenol or a cresol, or a dihydric phenol such as resorcinol, or mixtures thereof, and formaldehyde under alkaline conditions. The molar ratio of phenol to formaldehyde will usually be from 1:1 to 1:3.

Alkali, such as sodium hydroxide or potassium hydroxide, may be added as a solid or as an aqueous solution to an aqueous solution of the resin and the alkaline aqueous resin solution may then be mixed with the fines and curing agent. Alternatively the alkali may be added in solution to a mixture of the fines, aqueous resin solution and the curing agent. The amount of alkali used may be chosen depending on the setting or hardening time and ultimate strength of the agglomerates required and on the actual composition of the resin but will usually be from 20–60% by weight of the resin. The preferred alkali is potassium hydroxide.

Examples of polyhydric alcohol esters which may be used as curing agent for the resin include commercial diacetin which is a mixture of mono-, di- and triacetin, commercial ethylene glycol monoacetate which is a mixture of ethylene glycol monoacetate and ethylene glycol diacetate, triacetin, ethylene glycol diacetate, propylene glycol diacetate and alpha-butylene diacetate. Examples of suitable carbonate esters include cyclic carbonate esters such as propylene carbonate and a solution of ethylene carbonate in propylene carbonate. Examples of suitable lactones include propiolactone, butyrolactone, valerolactone and caprolactone. If desired different types of ester may be used in combination, for example propylene carbonate and ethylene glycol diacetate.

The quantity of alkaline phenolformaldehyde resole resin solution used will usually be 1–5% by weight based on the weight of the coal fines, and the quantity of curing agent will usually be 15–30% by weight based on the weight of the resin solution.

When the coal fines, resin solution and curing agent are mixed together it is preferred to disperse the curing agent on the surface of the coal fines first and then to add and disperse the resin solution.

The resulting mixture may then be formed into agglomerates such as briquettes by any of the means commonly used to produce coal briquettes.

The preferred method of producing the agglomerates is to compact the mixture in moulds under pressure using a ramming press, preferably having a plurality of heads, and optionally while vibrating the moulds.

The agglomerates will usually begin to cure and develop strength after about 30 to 45 minutes, but full strength development will not occur, particularly when the starting coal fines contain moisture, until water has been removed. Drying of the agglomerates by air drying at ambient temperature or by thermal treatment at a higher temperature must therefore be carried out.

If desired a minor proportion of a thermoplastics material such as polyvinyl alcohol or an acrylic polymer may be used as a partial replacement for the resin binder and such a material may improve the surface hardness of the agglomerates. The thermoplastics material may be added as an emulsion in water and it may be convenient to premix the ester curing agent with the emulsion. If this is done it is desirable to add a small proportion, for example 0.5% by weight based on the weight of the ester-emulsion mixture, of a surfactant in order to stabilise the emulsion after addition of the ester.

Coal agglomerates, such as briquettes, are required to retain strength when they are burned. In order to improve "hot strength" it may be desirable to include a small quantity of a material which will improve the caking property of the briquettes. For example when producing briquettes from anthracite fines finely ground coking coal or bitumen may be added. The quantity used will usually be of the order of 1–10% by weight based on the weight of the coal fines. Larger quantities of materials such as coking coal or bitumen are undesirable because these materials produce smoke when burned.

The following example will serve to illustrate the invention:

An alkaline phenol-formaldehyde resole resin was prepared by blending 26 parts by weight of an aqueous potassium hydroxide solution containing 50% by weight of potassium hydroxide and 74 parts by weight of a phenolformaldehyde resin having a phenol to formaldehyde molar ratio of 1: 1.7. 0.25 parts by weight of gamma-amino propyltriethoxy silane were then added.

An emulsion in water of an ester curing agent for the resin and a styrene-acrylic polymer having the following composition by weight was then prepared:

| | |
|---|---|
| Styrene-acrylic polymer emulsion (50% by weight solids) | 50.0% |
| Propylene carbonate | 25.0% |
| Ethylene glycol diacetate | 18.0% |
| Anionic surfactant | 0.5% |
| Water | 6.5% |

Anthracite fines having a particle size 100% less than 12700 microns and 95% greater than 500 microns and containing 5–6% by weight moisture were mixed with 0.8% by weight of the emulsion based on the weight of the coal fines and 5% by weight of finely ground coking coal (100% less than 250 microns) based on the weight of the coal fines. 2% by weight of the resin based on the weight of the fines were then added and dispersed.

The resulting mixture was then formed into briquettes by moulding under a pressure of 28–32 kg/cm$^2$ and dried in an oven at 110° C. for 20 minutes.

The briquettes produced had good surface hardness, were water resistant, and had a compression strength of 17 to 25 kg/cm$^2$. After being placed in a furnace at 1000° C. for 10 minutes the briquettes were still intact indicating that they had good hot strength.

I claim:

1. A process for the agglomeration of coal fines comprising (a) producing a mixture which consists essentially of (i) coal fines, (ii) a phenol-formaldehyde resole resin in alkaline aqueous solution, and (iii) a curing agent for the resin, the curing agent being at least one ester selected from the group consisting of esters of polyhydric alcohols, carbonate esters and lactones, (b) forming the mixture into agglomerates and (c) drying and curing the agglomerates.

2. A process according to claim 1 wherein the coal fines are anthracite fines or bituminous coal fines.

3. A process according to claim 2 wherein the coal fines are anthracite fines containing 5–10% by weight moisture.

4. A process according to claim 1 wherein the phenol-formaldehyde resole resin has a molar ratio of phenol to formaldehyde of from 1:1 to 1:3.

5. A process according to claim 1 wherein the amount of alkali present is 20–60% by weight based on the weight of phenol-formaldehyde resin.

6. A process according to claim 1 wherein the curing agent is a mixture of mono-, di- and triacetin, a mixture of ethylene glycol monoacetate and ethylene glycol diacetate, triacetin, ethylene glycol diacetate, propylene glycol diacetate, alpha-butylene diacetate, propylene carbonate, a solution of ethylene carbonate in propylene carbonate, propiolactone, butyrolactone, valerolactone or caprolactone.

7. A process according to claim 1 wherein the quantity of alkaline phenol-formaldehyde resole resin solution used is 1–5% by weight based on the weight of the coal fines and the quantity of curing agent is 15–30% by weight based on the weight of the resin solution.

8. A process according to claim 1 wherein a minor proportion of a thermoplastics material is included in the mixture.

9. A process according to claim 8 wherein the thermoplastics material is added as an emulsion in water.

10. A process according to claim 9 wherein the emulsion is premixed with the curing agent.

11. A process according to claim 10 wherein the thermoplastics material is polyvinyl alcohol or an acrylic polymer.

12. A process according to claim 2 wherein the coal fines are anthracite fines and 1–10% by weight of finely ground coking coal or bitumen based on the weight of the coal fines are included in the mixture.

13. A process according to claim 1 wherein the curing agent is dispersed on the surface of the coal fines and the resin solution is then added and dispersed to form the mixture.

14. A process according to claim 1 wherein the agglomerates are formed by compacting the mixture in moulds under pressure using a ramming press.

* * * * *